United States Patent [19]

Finkbeiner

[11] Patent Number: 4,669,666

[45] Date of Patent: Jun. 2, 1987

[54] SHOWER HEAD

[75] Inventor: Werner Finkbeiner, Schiltach, Fed. Rep. of Germany

[73] Assignee: Hans Grohe GmbH & Co. KG, Fed. Rep. of Germany

[21] Appl. No.: 827,329

[22] Filed: Feb. 7, 1986

[30] Foreign Application Priority Data

Feb. 16, 1985 [DE] Fed. Rep. of Germany ..... 3505438

[51] Int. Cl.[4] ..... A62C 31/00; B05B 1/32

[52] U.S. Cl. ..... 239/438; 239/442; 239/448; 239/449; 239/456

[58] Field of Search ..... 239/436, 437, 438, 442, 239/448, 449, 456, 583

[56] References Cited

U.S. PATENT DOCUMENTS

| | | | |
|---|---|---|---|
| 294,675 | 3/1884 | Richter | 239/456 |
| 894,558 | 7/1908 | Wheaton | 239/583 |
| 2,949,242 | 8/1960 | Blumberg et al. | 239/456 X |
| 2,968,443 | 1/1961 | Manning | 239/456 X |
| 3,533,559 | 10/1970 | Caird | 239/456 X |
| 4,117,979 | 10/1978 | Lagarelli et al. | 239/381 |
| 4,324,364 | 4/1982 | Buzzi et al. | 239/449 X |

FOREIGN PATENT DOCUMENTS 2613618 5/1981 Fed. Rep. of Germany .

*Primary Examiner*—Andres Kashnikow
*Assistant Examiner*—Patrick N. Burkhart
*Attorney, Agent, or Firm*—Steele, Gould & Fried

[57] ABSTRACT

A shower head contains a cup-shaped casing with a longitudinally displaceably held core part, for whose displacement an eccentrically-mounted circular disc engages in an opening of the core part. The eccentrically-mounted circular disc contains an eccentrically arranged hole, through which engages a square section of an adjusting member. Within the casing, the adjusting member is mounted in a sleeve in part of the shower head which does not carry water. The adjusting member does not require packings.

18 Claims, 10 Drawing Figures

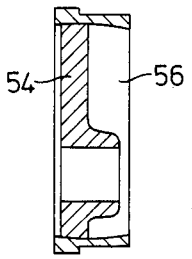
FIG. 8
FIG. 9a
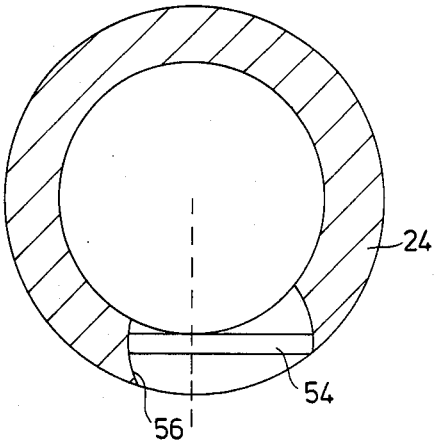
FIG. 9b
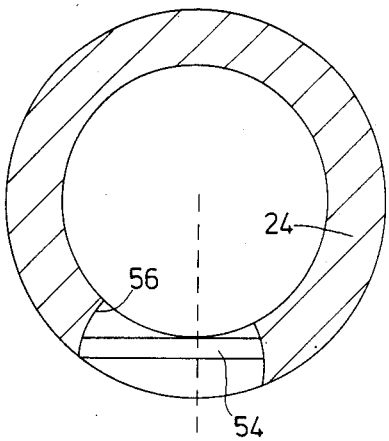

SHOWER HEAD

BACKGROUND OF THE INVENTION

The present invention relates to a shower head with a cup-shaped casing and a core part held displaceably within the casing for modifying the spray pattern of the shower head and for whose displacement a cam engages in an opening in the core part, whilst an adjusting member mounted in the casing and accessible from outside said casing is rotationally connectable with the cam.

Such a shower head is known from U.S. Pat. No. 4,117,979, where the adjusting member is mounted in the casing wall and for this purpose the wall is greatly thickened in the vicinity of the mounting. The adjusting member pivot bearing is sealed, because the cam projecting into the interior of the casing is arranged in an area which carries water. The actual cam is formed by a pin which is relatively narrow with respect to the mounting and which engages in an elongated hole. The latter extends at right angles to the general water passage direction of the shower head. The cam application point is close to the median longitudinal plane of the shower head. Due to this and the elongated hole construction the cam only engages linearly on the core part, said line being directed radially and having a very short length. This leads to high surface pressures causing wear phenomena and after a while the adjusting mechanism no longer works cleanly. In addition, there is a risk that the sealing of the adjusting member mounting will be subject to wear, so that water then leaks out in the vicinity of the adjusting member.

Another shower head is known (DE-AS No. 26 13 618), in which an adjusting member is mounted in the casing. By means of an eccentric disc, the adjusting member engages on an outer displaceable jacket, the mounting taking place with the aid of a spindle, which passes through the water-carrying part of the casing and must therefore be sealed at two points. The eccentric disc engages on the outer jacket of the shower head, so that wear phenomena occur here after a short time, leading to an unattractive appearance, which is particularly undesired in the field of sanitary fittings.

SUMMARY OF THE INVENTION

The object of the present invention is to improve a shower head of the aforementioned type with a view to better and longer durability and simpler construction.

According to the invention this problem is solved in that the cam has an eccentrically mounted, circular disc, which engages in a circular opening of the core part Thus, no longer does an eccentric revolving pin engage in an opening, this being replaced by an eccentrically mounted relatively large diameter disc, which engages in a circular opening. This leads at least to a linear engagement along the entire circumference of the disc, i.e. much lower surface pressure. However, unlike in the arrangement according to DE-AS No. 26 13 618 the eccentricallly-mounted circular disc does not engage on the outer jacket, instead engaging on the inner core part, so that the eccentric disc is not visible from the outside and any traces of wear which occur are also invisible from the outside. The opening enabling the adjusting member to connect through the outer casing can be smaller than the eccentrically-mounted disc, so that the adjusting mechanism does not influence the outer contours.

According to a further development of the invention, the eccentrically-mounted circular disc has an eccentrically positioned hole, through which can be passed a pin forming the pivot pin of the adjusting member for the purpose of its rotational connection with the eccentrically-mounted circular disc. The eccentric disc arranged in the interior of the arrangement can in this way be connected to the adjusting member, so that the latter can also be removed. Hereagain the eccentrically-mounted disc remains in the casing, and cannot be removed and destroyed, so that this construction is particularly appropriate for public baths.

According to a further development, the mounting of the control member is arranged within the casing and preferably extends over and beyond the centre of the casing. This makes it possible to favourably absorb the forces occurring during adjustment and also to move the eccentrically-mounted circular disc as far as possible to the outside, so that the twisting of the core part about the longitudinal axis simultaneously occurring due to the eccentrically-mounted circular disc during the longitudinal displacement can be kept small. This leads to more favourable conditions for the construction of the opening in the core part, which receives the eccentrically-mounted circular disc.

According to a further development the pivot pin of the adjusting member is mounted in a sleeve passing transversely through the casing. As a result of this arrangement the pivot pin can be mounted in large area manner, which is advantageous for the durability of the arrangement. It is also relatively simply possible to construct this sleeve in such a way that it is completely located in an area through which water does not flow. Thus, the complete adjusting arrangement is located in a part which does not carry water, so that no seals or packings are required.

According to the invention, the casing has an internal coaxial and roughly cylindrical shoulder, through which the liquid is passed and which is traversed by a sleeve, the water flowing laterally past the latter. This transversely directed sleeve can e.g. be constructed in one piece with the shoulder or bonded thereto, so that it is free from water and can be used for mounting the pivot pin.

For good guidance purposes the core part can slide on the shoulder and for this purpose the shoulder and/or core part can have longitudinal ribs, which take over guidance in the case of limited friction.

According to the invention, the wall of the core part is thickened, at least in the vicinity of the eccentrically-mounted circular disc engagement opening. The wall of the core part, which has a roughly sleeve-like construction, is positioned between the inner shoulder and the outer wall of the casing. Thus, in the vicinity of the eccentrically mounted circular disc opening the core part can be made almost as wide as the radial spacing between the inner shoulder and the outer wall of the casing. The thickening of the core part in this area has the advantage that the eccentrically mounted circular disc can engage relatively flatly on the edge of the opening.

According to the invention, in the vicinity of its free end, the inner shoulder can have several radial openings, whilst the core part in said area can have a set of radial recesses or openings. Thus, the water passes out of the end region of the inner shoulder, through the radial openings of the core part and from there via a jet disc into the open.

The core part can be given a second set of openings and in this case the adjustability of the core part can be used for switching between two different water exit systems, e.g. between an external normal jet and an internal vented jet. To this end it can be provided that in one end position of the core part the openings of the inner shoulder are connected with the first set of openings and in the second end position with the other set of openings of the core part. However, it is also possible to provide only a single jet exit system, the adjusting member then being used e.g. for modifying the quantity of the outflowing water or the hardness of the jet.

In order to improve the engagement between the eccentrically mounted disc and the opening of the core part, the outer edge of said disc can have an arcuate shape in a radial cross-section. This makes it possible to permit, at least zonally, a large-area engagement of the outer edge of the eccentrically mounted disc.

The pin forming the pivot pin can have a cross-sectionally rectangular square and the eccentrically-mounted disc has a correspondingly shaped hole. This makes it possible to insert the pin only in a specific position of the disc, so that the user can recognise the state of the shower head from the outside on the basis of the adjusting member position.

The pin is preferably lockably mounted in the vicinity of its inner end, so that the adjusting member can be engaged to ensure that it is relatively firmly held. However, if desired, the adjusting member can be removed together with the pin, so that the once set position of the core part is retained.

According to the invention, between the core part and the casing, a packing is provided, which is preferably located in the area between the adjusting member pivot pin and the jet exit. The part of the inner area of the casing through which is passed the pin forming the pivot pin remains free from water. The packing can e.g. advantageously be a lip-type packing, which is mounted in the core part. It also serves for the pressure compensation of the annular space above the jet exit disc, so that no axial forces can occur on adjustment.

To further improve the engagement between the eccentrically mounted disc and the core part, the circular opening of the latter can be given an arcuate outer edge at least in a radial cross-section at right angles to the casing rotation axis and the curvature of this edge is the same as that of the eccentrically mounted circular disc edge.

According to the invention, the core part can be guided on the casing, preferably on its inner shoulder, over at least approximately half its length. Thus, a good engagement is ensured, even in the position where the core part is furthest in the direction of the shower exit end, which ensures a clean jet pattern of the discharged jet and the shower head can have a long life.

BRIEF DESCRIPTION OF THE DRAWINGS

The invention is described in greater detail hereinafter relative to non-limitative embodiments and the attached drawings, wherein show:

FIG. 8, a radial cross-section through the eccentrically-mounted circular disc and the sidewall of the internal sleeve.

FIGS. 9*a* and 9*b*, schematic illustrations showing interaction of the disc and sleeve.

DETAILED DESCRIPTION OF THE PREFERRED EMBODIMENTS

Figure 1:
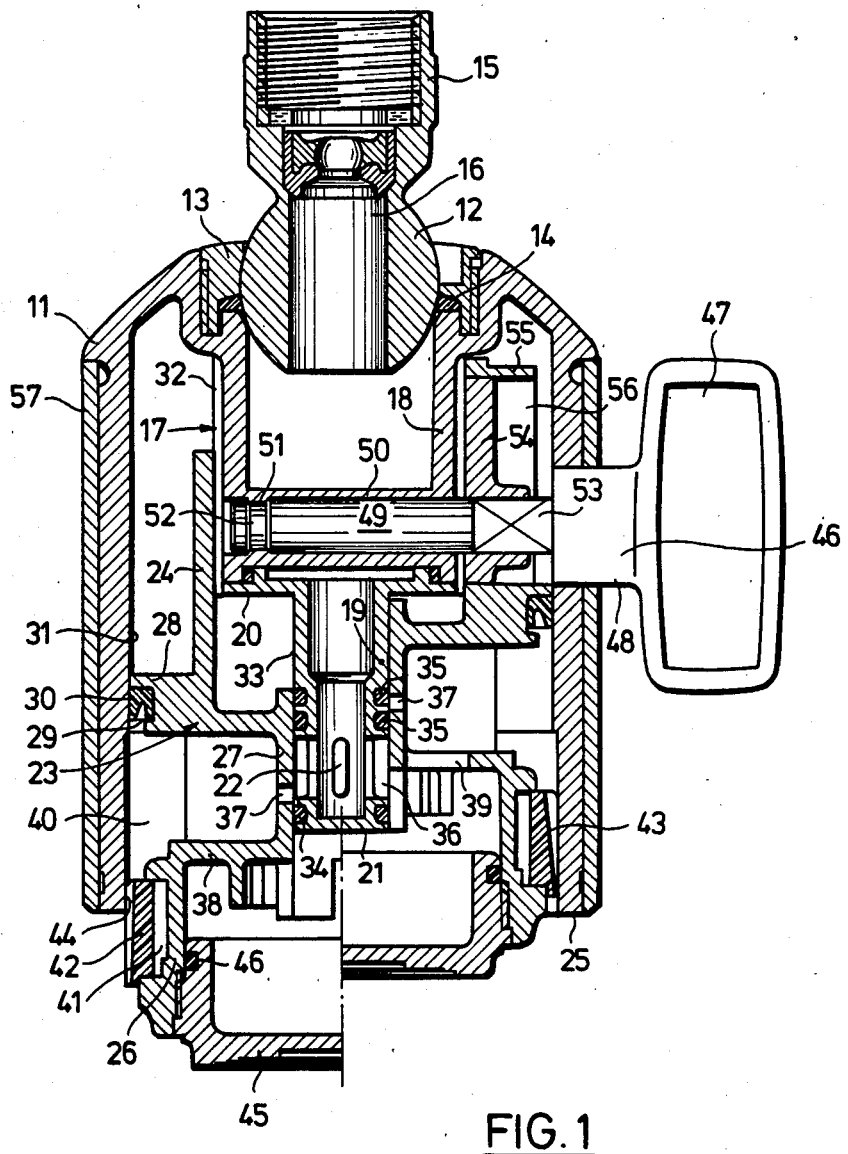
FIG. 1, a longitudinal section through a first embodiment of a shower head constructed according to the invention.

The shower head shown in longitudinal section in FIG. 1 contains an elongated, tubular casing 11, which is provided on its top surface in FIG. 1 with a spherical bearing member 12, which is fixed to the casing 11 with the aid of a cap nut 13, whilst interposing a packing 14. On its side remote from the casing 11, it contains a threaded connection 15 for the connection to a water main or the like. The bearing member 12 is traversed by a through bore 16. In its interior, casing 11 contains a coaxially arranged cylindrical shoulder 17, which has an inner part 18 and a smaller diameter outer part 19 connected thereto. Shoulder 17 is hollow, the outer part 19 being provided with a plate 20, which is welded to the free end of the inner part 18 of shoulder 17. In the vicinity of its end 21, the smaller diameter outer part 19 has several openings 22, which are constructed in slot-like manner and whose longitudinal extension runs parallel to the general water discharge direction.

A core part 23 is longitudinally displaceably arranged in the interior of casing 11. The core part 23 contains a sleeve 24 directed towards the bearing member 12 and a sleeve 26 directed towards the free end 25 of casing 11, the two being interconnected by a short pipe section 27. In the vicinity of its connection to the pipe section 27, sleeve 24 has an outwardly directed, all-round, wide rib 23, which is provided with a groove 29 for receiving a lip-type packing 30, which engages on the inside 31 of casing 11.

Cylindrical sleeve 24 is constructed in such a way that its inside engages on ribs 32, which are arranged on the outside of the inner part 18 of cylindrical shoulder 17 and are longitudinally directed. Pipe section 27 has an internal diameter such that it engages flat on the outside 33 of the outer part 19 of shoulder 17.

Considered in the longitudinal direction of shoulder 17, its outer part has a packing 34 on one side and two packings 35 on the other side. In the region between these packings, i.e. in the vicinity of openings 22, the outer part 19 of shoulder 17 has an all-round groove 36, whose width roughly corresponds to the length of openings 22.

In the vicinity of pipe section 27, core part 23 has a plurality of radial openings 37 distributed over the circumference, which are connected to groove 36 in the representation of the left-hand half. In the representation of the right-hand half in FIG. 1, the openings 37 are located in the vicinity of packings 35 and are not therefore connected to groove 36.

The bottom 38 of the outer sleeve part 26 also has openings 39 through which water can flow from groove 36 when the shower head is in the position shown in the right-hand half from groove 36 into the annular space 40 formed between the two sleeves 24 and 26.

Sleeve 26 is provided on its outer wall with a groove 41, in which is inserted a jet disc 42, which has slightly conical grooves 43, which are interrupted by the individual ribs 44. Due to the slight conicity of grooves 43, when core part 23 is moved into the interior of casing 11, the distance between the outer face 43 of jet disc 42 and the inside 31 of casing 11 becomes smaller, so that as a result the jet configuration or the speed of the discharged water can be modified.

Sleeve 26 is terminated towards the outside of the shower head by a cup-shaped cover 45, which engages in sleeve 26 and is locked there. It contains a packing 46, which prevents an outflow of water.

An adjusting member 46 is provided for the longitudinal displacement of core part 23. Adjusting member 46 contains a grip 47 arranged radially outside casing 11, a circular cylindrical shoulder 48 of said grip engaging through an opening in the outer wall of casing 11. The adjusting member 46 also has a pin 49, which is shaped in one piece and which passes through casing 11 up to the opposite side of inner shoulder 17. The latter has in its wider part 18 a sleeve 50 which radially traverses the same and whose internal diameter corresponds to the external diameter of pin 49. On its inside, sleeve 50 has an all-round rib 51, which engages in a corresponding groove 52 of pin 49 and consequently locks the latter. A cross-sectionally rectangular section 53 is formed between 49 and cylindrical shoulder 48. Square section 53 engages in an eccentrically arranged opening of an eccentrically-mounted circular disc 54. Side wall 55 of sleeve 24 is thickened in this area and contains a cross-sectionally roughly circular opening 56, in which engages the eccentric disc 54. The thickness of wall 55 in this area exceeds the thickness of the eccentrically-mounted circular disc.

On turning grip 47 of adjusting member 46, there is also rotation of eccentrically-mounted circular disc 54, so that the core part 23 is displaced by the engagement of disc 54 in opening 56. This leads to a longitudinal displacement of core part 23 from the internal position shown in the right-hand half of FIG. 1 into the external position of core part 23 shown in the left-hand half of the drawing. There is simultaneously a twisting of core part 23 about its longitudinal axis. The longitudinal displacement leads to a modification of the spray pattern. Due to the great length of pin 49, adjusting member 46 is favourably mounted and eccentrically-mounted circular disc 54 engages on the inside of opening 56 over a relatively large surface. As a result of the arrangement of sleeve 50, which can be in one piece with shoulder 17 and the arrangement of the lip-type packing 30 outside sleeve 50, it is ensured that the complete mounting of the adjusting member 46 is located in a shower head area which does not carry water. The water flows past sleeve 50 upstream and downstream of the plane of the drawing. There is no risk of water passing out of the hole through which passes shoulder 48 of adjusting member 46. Due to the mounting in the interior of the casing, there are also no forces in the vicinity of the outer wall of casing 11, so that no traces of wear are visible even after prolonged use. The casing contains an external jacket 57, which is subsequently snapped on.

Figure 2:
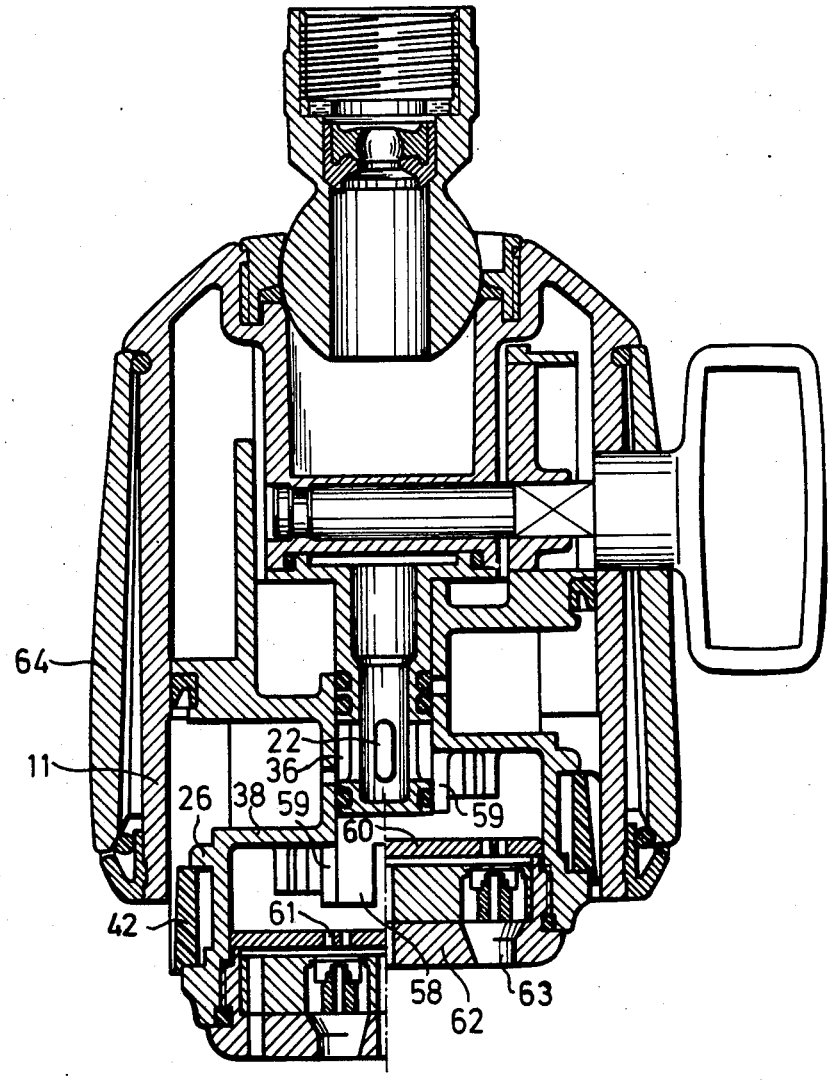
FIG. 2, a longitudinal section through a second embodiment.

The embodiment of FIG. 2 essentially differs from that of FIG. 1 in that the outer sleeve 26 of core part 23 has a closed bottom 38. However, an inner shoulder 58 on the bottom 38 of sleeve 26 has individual slots 59 through which the water can flow in the inserted position of core part 23 via openings 22 and groove 36 into the interior of sleeve 26. Sleeve 26 has a partition 60 with individual hole groups 61 and below which is arranged a jet base 62 with several holes 63, which produces a soft or smooth jet. In the embodiment according to FIG. 2, it is possible to switch between a position in which the water only passes out between the jet disc 42 and the edge of casing 11 and a position in which the water only passes through the jet base 62. In the embodiment according to FIG. 2, the outer jacket 64 is fixed in another way. Otherwise the embodiment of FIG. 2 is identical with that of FIG. 1.

Figure 3:
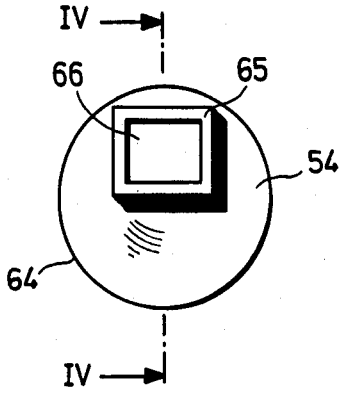
FIG. 3, a plan view of the eccentrically mounted circular disc.

FIG. 3 is a plan view of eccentrically-mounted circular disc 54, which has a circular outer contour 64 on its one side it contains an eccentrically arranged shoulder 65, which forms a rectangular hole 66 in its interior. The shoulder increases the bearing surface of the square 53 on the eccentrically-mounted circular disc.

Figure 4:
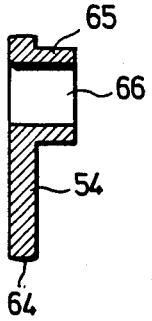
FIG. 4, a radial cross-section through the eccentrically mounted circular disc according to FIG. 3.

FIG. 4 shows a radial cross-section through eccentrically-mounted circular disc 54. The outer edge 64 of eccentric disc 54 is made Since during the rotation of eccentric disc 54, there is not only a longitudinal displacement, but simultaneously also a rotation of sleeve 24 around core part 23, the arcuate construction of the outer edge 64 of eccentric disc 54 has the advantage that on rotation, there is an at least zonal full-surface engagement between disc 54 and opening 56. Thus, the surface pressures which occur are kept small, which improves the life and durability of the arrangement.

Figure 5:
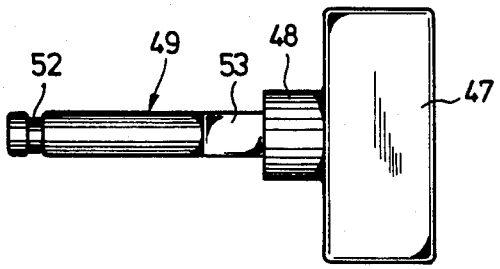
FIG. 5, a side view of the adjusting member with its pivot pin.
Figure 6:
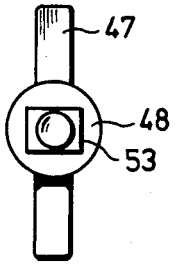
FIG. 6, a view of the adjusting member from the left in FIG. 5.
Figure 7:
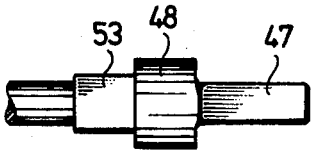
FIG. 7, a view of the adjusting member from the top in FIG. 5.

FIG. 5 is a side view of the adjusting members 46 of FIGS. 1 and 2. The comparison of FIGS. 5 and 7 shows that the square section 53 has a rectangular, i.e. non-square cross-section, so that the adjusting member 46 can only be inserted in eccentric disc 3 in two positions differing by 180°. It is also possible to see the circular cylindrical shoulder 48 arranged between square 53 and grip 47 and which fills the circular hole in casing 11.

The groove 52, which cooperates with rib 51 on the inside of sleeve 50, brings about an engagement of adjusting member 46. However, the latter can be removed again if an adjustment of the shower is not required, e.g. in public baths. The locking mounting can also be used for replacing the adjusting member 46.

FIGS. 8, 9*a* and 9*b* further illustrate the embodiment in which the disc 54 has an arcuate outer edge complemented by the arcuate inner surface of opening 56 in inner sleeve 24. Sleeve 24 rotates relative to the axis of rotation of ecentrically-mounted circular disc 54. The arcuate facing surfaces of disc 54 and opening 56 allow the disc 54 and the sleeve 24 to remain in contact.

What is claimed is:

1. A shower head, comprising:

a cup-shaped casing and a core part displaceably mounted within the casing for modifying a spray pattern of the shower head, displacement of the core part in the casing being controllable by means of a cam with an eccentrically-mounted circular disc engaging in a circular opening of the core part, an adjusting member mounted in the casing and accessible from outside the casing being connectable to the cam, the eccentrically-mounted circular disc having an eccentrically positioned hole, through which can be passed a pin forming a pivot pin of the adjusting member for rotationally fixing the adjusting member and the disc.

2. A shower head, comprising:

a cup-shaped casing and a core part displaceably mounted within the casing for modifying a spray pattern of the shower head, displacement of the core part being controllable by means of a cam with an eccentrically-mounted circular disc engaging in a circular opening of the core part, an adjusting member mounted in the casing and accessible from outside the casing being operable to rotate the cam, the adjusting member being arranged within the casing and the adjusting member extending transversely through a longitudinal center of the casing.

3. A shower head according to claim 2, wherein a pivot pin of the adjusting member is mounted in a sleeve passing transversely through a part of the casing defining a water flow path.

4. A shower head according to claim 1, wherein the casing has an internal coaxial and approximately cylindrical shoulder through which water is passed and which is traversed by a sleeve past which the water laterally flows.

5. A shower head according to claim 4, wherein the core part is slidingly guided on the shoulder.

6. A shower head according to claim 4, wherein the core part has a thickened wall at least in a vicinity of an engagement opening in the core part receiving the eccentrically mounted circular disc.

7. A shower head according to claim 4, wherein the inner shoulder and the core part are each provided with a plurality of radial openings adjacent an outer end of the inner shoulder.

8. A shower head according to claim 7, wherein the core part has a second set of openings.

9. A shower head according to claim 8, wherein in one position of the core part, the openings of the inner shoulder are connected to the first set of openings, and in a second position the openings of the inner shoulder are connected with the second set of openings.

10. A shower head according to claim 1, wherein the pivot pin has a cross-sectionally rectangular square shaped part and the eccentrically-mounted circular disc has a correspondingly shaped hole for receiving the pin.

11. A shower head according to claim 1, wherein the pin is held in the core part at an inner end of the pin.

12. A shower head according to claim 1, wherein a packing is arranged between the core part and the casing in a region between the pivot pin of the adjusting member and a water jet outlet.

13. A shower head according to claim 1, wherein the core part is guided on the casing over at least roughly half a length of the core part.

14. A shower head according to claim 13, wherein the core part is guided on an inner shoulder the casing.

15. A shower head according to claim 11, wherein the pin is held in lockable manner at the inner end of the pin.

16. A shower head, comprising:

a cup-shaped casing and a core part displaceably mounted in the casing for modifying a spray pattern of the shower head, the core part being rotatable and displaceable on a longitudinal axis relative to the casing, the core part being positionable by means of a cam rotatable using an adjustment member, the cam having an eccentrically-mounted circular disc engaging in a circular opening of the core part, the longitudinal axis of the circular opening of the core part and the eccentrically mounted circular disc being oriented orthogonally to said longitudinal axis, whereby rotating the adjustment member causes rotation and displacement of the core part in the casing.

17. A shower head according to claim 16, wherein an outer edge of the eccentrically-mounted circular disc has an arcuate shape in radial cross-section.

18. A shower head according to claim 17, wherein the circular opening of the core part has an arcuate edge at least in a radial cross-section at right angles to a rotation axis of the core part in the casing and this edge has a same curvature as that of an outer edge of the

* * * * *